United States Patent [19]

Robbins

[11] Patent Number: 4,903,363

[45] Date of Patent: Feb. 27, 1990

[54] MULTIPLE DYE SETTING STEAM CHAMBER APPARATUS AND METHOD

[76] Inventor: Ronald B. Robbins, 619 Meadowbrooke Ct., Duncanville, Tex. 75137

[21] Appl. No.: 346,468

[22] Filed: May 2, 1989

Related U.S. Application Data

[63] Continuation-in-part of Ser. No. 104,681, Oct. 5, 1987, Pat. No. 4,828,567.

[51] Int. Cl.[4] ..... D06B 11/00; D06B 23/18

[52] U.S. Cl. ..... 8/149.3; 68/5 C; 68/5 E

[58] Field of Search ..... 8/149.3, 476; 68/5 C, 68/5 E, 6, 222, 240; 223/70, 73, 76, 79

[56] References Cited

U.S. PATENT DOCUMENTS

| | | | |
|---|---|---|---|
| 56,697 | 7/1866 | Bronn | 8/149.3 X |
| 1,198,373 | 9/1916 | Olson | 8/149.3 X |
| 1,326,982 | 1/1920 | Spencer | 68/240 X |
| 1,785,619 | 12/1930 | Easton, Jr. | 68/6 |
| 2,254,691 | 9/1941 | MacLelland, Jr. | 68/240 X |
| 3,330,451 | 7/1967 | Gordon | 68/6 X |
| 3,761,977 | 10/1973 | Rappaport | 8/149.3 |
| 4,083,205 | 4/1978 | Clarke et al. | 68/5 C |
| 4,421,794 | 12/1983 | Kinsley, Jr. | 8/149.3 X |

FOREIGN PATENT DOCUMENTS

| | | | |
|---|---|---|---|
| 530724 | 7/1955 | Italy | 68/240 |
| 588526 | 2/1959 | Italy | 68/6 |
| 1229792 | 4/1971 | United Kingdom . | |

*Primary Examiner*—Philip R. Coe

*Attorney, Agent, or Firm*—Litman, McMahon and Brown

[57] ABSTRACT

A dye setting apparatus for use with carpets, mats and the like comprises a cover having a generally planar interior surface pivotally connected to a support surface. The cover includes a steam containment and support structure having an interior channel flow connected to a steam source. The cover, support structure and support surface form a confinement chamber for the carpet. Steam is released into the chamber from apertures in the support structure to set dye in the carpet. The interior surface of the cover is constructed of a material which is generally non-heat conductive and somewhat water absorbent, such as plywood, to prevent steam from condensing as droplets on the interior of the cover and dropping on the carpet during dye setting. An alternative embodiment includes multiple stacked covers that form multiple chambers, each chamber adapted to receive a mat and steam therein such that dye may be set on multiple mats simultaneously.

10 Claims, 3 Drawing Sheets

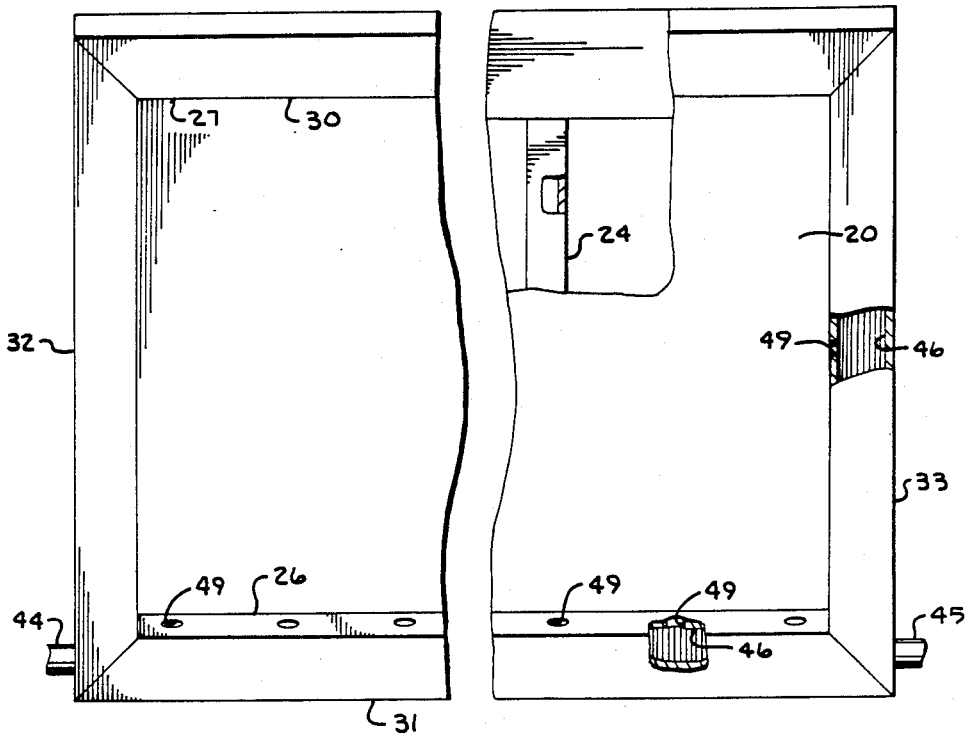
Fig. 4.
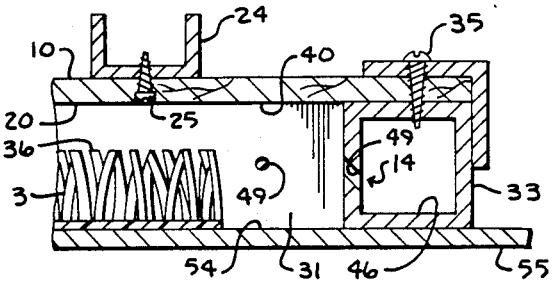
Fig. 5.
Fig. 6.
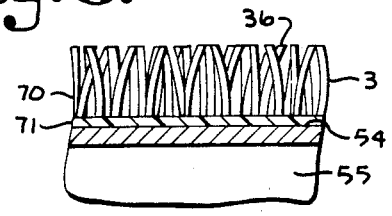

MULTIPLE DYE SETTING STEAM CHAMBER APPARATUS AND METHOD

CROSS-REFERENCE TO RELATED APPLICATION

The present application is a continuation-in-part of Ser. No. 104,681, filed Oct. 5, 1987 entitled Dye Setting Steam Chamber Apparatus and Method, now U.S. Pat. No. 4,828,567.

BACKGROUND OF THE INVENTION

The present invention relates to devices for setting dyes in a fabric material and, in particular, to setting dyes by the application of steam heat in carpets, mats and the like, especially carpets having rubber or vinyl backing.

Large, cumbersome steam cabinets have been used for many years to heat dye placed in designs on the surface of carpets and mats, such that the dye is set in the fabric and, thereafter, not substantially removed or displaced by washing or the like. The conventional cabinets have been quite large, taking a substantial amount of space, and typically require a relatively large source of steam, for example a full-size steam boiler. These conventional cabinets are designed to remain in a fixed position and are mobile only upon substantial disassembly. That is, the conventional cabinets are not usable at multiple locations without a great deal of work and effort. These cabinets would definitely not be considered portable in the normal sense of the word.

Historically, these conventional steam cabinets have included some type of conveyor system which transports carpets or the like with dye positioned on the surface thereof through the cabinet during which the carpet is heavily infused with steam to heat it and set the dye. Because of the substantial amount of steam used, the rubber or vinyl backing cannot be added to the carpet in a conventional process until after the dye is set. Otherwise, the backing would become overheated and tend to blister and distort.

In addition, conventional steam cabinets have typically suffered from the problem of steam condensing on the surface of the cabinet above the carpet and subsequently dripping on the carpet, thereby disrupting the dye and distorting the pattern formed. Several attempts have been made to correct this problem in conventional cabinets which have included substantially arcing the upper interior surface of the lid of the cabinets so that condensation runs down arched sides of the lid rather than dripping onto the carpet; however, this makes the interior chamber quite large and inefficient.

Another procedure utilized to avoid water droplets on the roof of the conventional cabinets has been to run an electrical heating element on the inner surface which is designed to evaporate any condensation before it has a chance to form droplets. This extra heating element increases the complexity of the device and adds to the cost of operation of the cabinet.

It is also desirable to have the capability to set dye on multiple mats simultaneously. This is especially true where a single operator has a large backlog or continuous heavy influx of mats. Nevertheless, it is also desirable to limit the number of dye setting devices due to space and cost limitations. Consequently, a need in the industry exists for an apparatus having the capability to set dye on multiple mats simultaneously, while using relatively little space.

OBJECTS OF THE INVENTION

Therefore, the objects of the present invention are: to provide a dye setting apparatus including a steam diffusion chamber for use in setting dyes in carpets, mats and the like; to provide such an apparatus which is relatively portable; to provide such an apparatus including a cover for forming the steam chamber in cooperation with a lower surface wherein the chamber is entirely enclosed in use, relatively simple in shape and comparatively small in size; to provide such an apparatus wherein the cover has a lower surface constructed of a substantially non-conductive material such as wood, preferably plywood, to reduce the likelihood of condensation of steam by heat transfer between an interior an exterior surface of the cover; to provide such a cover which is substantially absorbent to absorb any moisture condensation which does occur on the surface thereof; to provide such an apparatus having a steam dispersion system to evenly distribute steam without entrained condensation and that collects condensation to return to steam generator; to provide such an apparatus having multiple stacked coves adapted to simultaneously receive multiple mats and steam so as to set dye on multiple mats at the same time; to provide such an apparatus which is relatively simple to use, inexpensive to produce and which is especially well adapted for the intended usage thereof; and to provide a method of setting dye in a carpet utilizing such an apparatus.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 4 is an enlarged and fragmentary front elevational view of the apparatus.

FIG. 5 is an enlarged and fragmentary cross-sectional view of the apparatus, taken along line 5—5 of FIG. 4, and showing the apparatus in a dye setting orientation thereof.

FIG. 6 is an enlarged and fragmentary cross-sectional view of the table and carpet, taken along line 6—6 of FIG. 1.

DETAILED DESCRIPTION OF THE INVENTION

Figure 1:
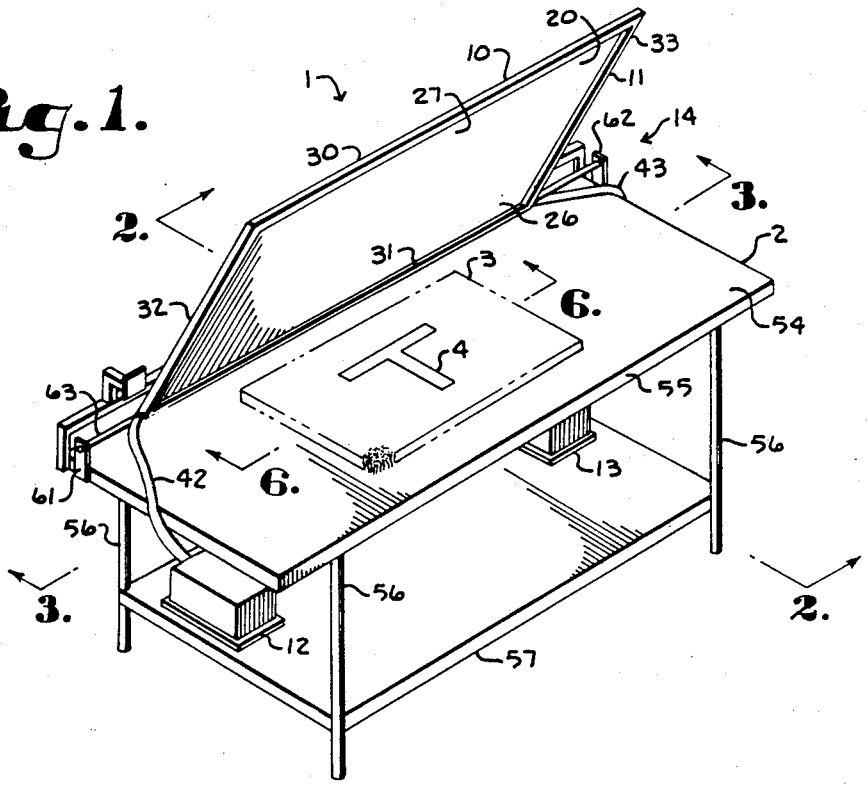
FIG. 1 is perspective view of a dye setting apparatus in accordance with the present invention illustrated in conjunction with a supporting table and showing a carpet with dye thereon to be set by the apparatus, and further showing the apparatus in a non dye setting orientation thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a dye setting apparatus in accordance with the present invention. The apparatus 1 is shown secured to a support table 2 with a carpet 3 having a dye pattern 4 thereon positioned on the table to have the dye pattern 4 set by the apparatus 1.

The apparatus 1 includes a cover 10, steam containment and cover support structure 11, steam generation means, such as steam generators 12 and 13, and a steam distribution system 14.

The apparatus 1 also includes a hinging mechanism 16 to connect and allow pivotal movement of the cover 10 relative to the table 2.

The cover 10 includes an elongate panel having a substantially planar lower surface 20 having dimensions which are at least as long or greater than the dimensions of the carpet 3. The surface 20 is preferably constructed of a substantially insulative material which will resist the transfer of heat between the surface 20 and an exterior surface 21 of the cover 10. In addition, the surface 20 is also preferably constructed of a material having at least a slight permeability relative to water and having a tendency to absorb small quantities of water. Wood, especially plywood, has been found to be particularly well adapted for construction of the surface 20; however, it is foreseen that other materials could function for this purpose while providing structural support to the cover 10 or alternatively could be structurally supported by other means. When plywood is used, it is preferred that a nonwater soluble glue-type plywood be utilized to prevent sap or resin from being drawn from the interior of the wood by the steam and to prevent disintegration of the wood.

The cover 10 includes a plurality of spaced crossbars 24 secured to the cover 10 by suitable fasteners 25 and constructed of aluminum channels or the like suitable for providing support to the cover 10. The crossbars 24 extend from a rear end 26 of the cover 10 to a front end 27 thereof.

The steam containment and cover support structure 11 comprises a front tube element 30, a rear tube element 31 and side tube elements 32 and 33. The elements 30, 31, 32 and 33 are generally rectangular, and are arranged so as to be joined at respective ends thereof in a rectangular configuration generally outlining the perimeter of the cover 10. The elements 30, 31, 32 and 33 are secured to the cover 10 by suitable fasteners 35 at spaced locations therealong. The width of each of the elements 30, 31, 32 and 33 is sufficient to support the cover 10 in relatively close, but spaced, relationship to an upper surface 36 of the carpet 3 when the apparatus 1 is being utilized to set the dye on the carpet 3, as shown in FIG. 4. Also, as will be discussed hereinafter, the structure 11 generally forms an enclosure or chamber 40 in conjunction with the cover 10 and table 2 when the cover 10 is placed in covering and surrounding relationship to the top 36 and sides of the carpet 3. In particular, the structure 11 extends between the table 2 and the cover 10 when the cover 10 is in covering relationship so as to obstruct or prevent steam from passing from the chamber 40 while dye is being set on the carpet 3. Preferably the cover 10, when in the dye setting orientation thereof (that is when the entire apparatus is in the dye setting orientation thereof), is horizontal and positioned such that the surface 20 is about one to one and a half inches from the carpet top surface. When the apparatus 1 is in the dye setting orientation thereof, as seen in FIG. 5, the bottom of the elements 30, 31, 32 and 33 generally contact and substantially seal with the table 2 so as to form the chamber 40 and prevent steam from escaping to the atmosphere.

The steam generators 12 and 13 are relatively small and portable. Such generators as 12 and 13 are available from various sources, including Jiffy Steamer Company of Union City, Tenn. Each of the steam generators 12 and 13 are attached to a steam output conduit 42 and 43 respectively. The output conduits 42 and 43 are, in turn, flow connected to nipples 44 and 45 respectively attached to side elements 32 and 33 and flow connecting to an interior thereof. The structure 11 includes the elements 30, 31, 32 and 33 joined together to form an interior channel 46. The channel 46 effectively outlines the perimeter of the cover 10 and is flow connected to the nipples 44 and 45 and, consequently, to the steam outputs of the steam generators 12 and 13. The interior surface of each of the elements 30, 31, 32 and 33 adjacent to the chamber 40 each include a plurality of spaced distribution apertures 49 therethrough. The apertures provide flow communication between the channel 46 and the chamber 40 when the apparatus 1 is setting dye on a carpet 3. In this way, steam is allowed to pass from the steam generators 12 and 13 into the chamber 40. Output from the steam generators 12 and 13 can be controlled by switching on the generators 12 and 13 themselves or it is foreseen that such output may also be controlled by a foot treadle or the like.

The apertures 49 are medially positioned between the top and bottom of respective elements 30, 31, 32 and 33 and are angled at approximately forty-five degrees relative to horizontal so as to be lower on the side of the channel 46. In this manner, steam that condenses in the channel 46 is collected beneath the apertures 49 and not directed on the carpet. The apertures 49 also direct the steam to the area above the carpet 3 so that an undue amount of steam does not condense at discrete locations on the carpet 3 directly in front of the apertures 49. The nipples 44 and 45 are positioned near the far back of the cover 10, preferably opening into the interior of the element 31 so that upon raising the cover 10 to a non dye setting orientation, as shown in FIG. 1, any condensed steam in the channel 46 is urged to collect in the element 31 and drain back to the generators 12 and 13 through the nipples 44 and 45 respectively. The elements 30, 31, 32 and 33 are preferably constructed of aluminum, which heats both evenly and quickly when steam is allowed to enter the channel, such that substantial condensation is avoided on the sides of the elements 30, 31, 32 and 33 facing the chamber 40.

The table 2 includes an upper planar surface 54 on a top 55 supported by legs 56. An intermediate shelf 57 is also connected to the legs 56 and utilized herein to support the steam generators 12 and 13. Although the table 2 is illustrated in conjunction with the apparatus 1 in the illustrated embodiment, it is foreseen that the apparatus 1 could be utilized in conjunction with virtually any structure having a substantially planar upper surface, such as 54, capable of supporting the carpet 3 and apparatus 1 and also adapted to seal with the cover support structure 11 when the apparatus 1 is in the dye setting orientation thereof to prevent excessive escape of steam.

The hinge mechanism 16 comprises a pair of support struts 61 and 62 secured to opposite sides of the tabletop 55 near the back thereof. An elongate pivot bar 63 extends between the struts 61 and 62 in spaced relationship to the surface 54. Hinge elements 65 are secured to the rear element 31 and cover 10 at the near end 26 thereof, and snugly surround the pivot bar 63 on the other end thereof so as to be pivotable relative thereto and to hold the cover 10 in an open position, as seen in FIG. 1. The hinge mechanism 16 allows the cover 10 to be pivoted upwardly at the front 27 thereof, as is shown in FIG. 1, to allow placement of the carpet 3 in place on the surface 54 for treatment by the apparatus 1 or, alternatively, to allow removal of the carpet 3 from the surface 54 after setting of the dye on the carpet 3. A plurality of cover supports 66 are positioned along the back of the table 2 to support the cover 10 when in an upward position while placing and removing carpets 3 from the table surface 54.

In use, a web or fabric, such as the illustrated carpet 3 is placed on the surface 54. As used herein, the term fabric refers to any material suitable for receiving a dye pattern 4 thereon and having the pattern set by the use of steam heat. Preferably, the fabric is a carpet or mat having an upper pile 70 and a rubber or vinyl preattached backing 71, see FIG. 6. The preferred dye is generally referred to as an acid dye and, in particular, an acid dye suitable for dying synthetic surface fibers used in the construction of carpet topped mats or the like. The dye is placed on the upper surface 36 of the carpet 3. The steam (humid heat rather than dry heat is preferred) is believed to swell the fiber of the carpet 3 and allow the dye 4 to migrate into the pile 70 to set therein. The dye 4 may be placed on the carpet surface 36 by a silkscreen process, airbrushing about a stencil or the like.

After the carpet 3 is in place, as shown in FIG. 1, the cover 10 is closed, as shown in FIG. 5. The generators 12 and 13 are started and steam is applied for sufficient time to allow the dye 4 to set. The carpet, with backing 71 in place, is then removed from the apparatus 1 by raising the cover 10 and manually lifting the carpet 3 from the surface 54.

The channel 46 and conduits are flushed with phosphoric acid or the like on an as-needed basis to remove debris therefrom.

Figure 2:
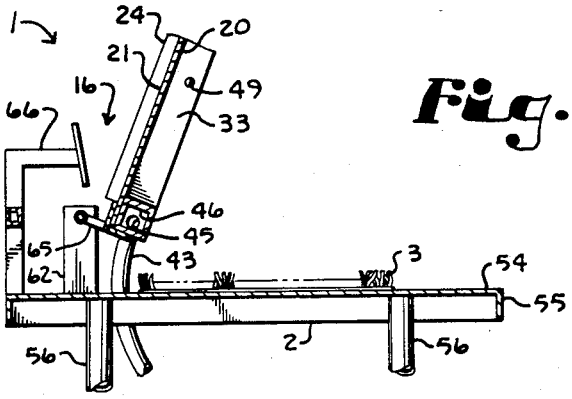
FIG. 2 is an enlarged and fragmentary view of the apparatus, table and carpet, taken generally along line 2—2 of FIG. 1.
Figure 3:
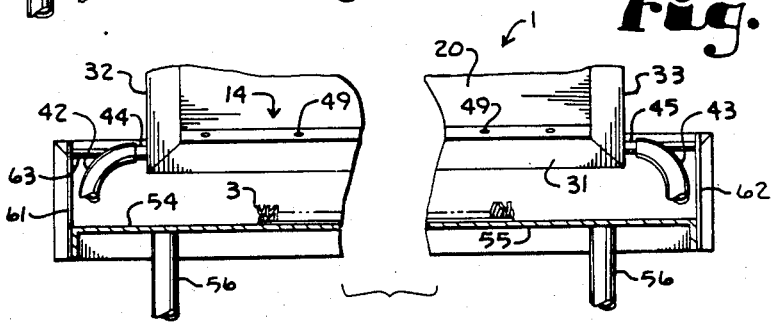
FIG. 3 is an enlarged and fragmentary view of the apparatus, table and carpet, taken generally along line 3—3 of FIG. 1.

It is foreseen within the scope of this invention that the carpet 3 could be both wider and longer than the cover 10, that is, the carpet 3 could be sufficiently large that the cover would not be able to completely enclose the carpet 3. For this purpose, the hinge mechanism operates to lift the cover 10 from engagement with the table surface 54 sufficiently to allow passage of the carpet 3 between the lower edge of the cover 10 and the surface 54 when the cover 10 is an open orientation thereof, as is shown in FIG. 2. In this manner, carpets which are larger than the cover 10 can be positioned beneath the cover 10 such that the cover support structure 11 rests on the upper surface of the carpet, rather than on the table surface 54 in such a manner as to generally form the steam containment chamber 40 with the carpet functioning to prevent excessive passage of steam from beneath the cover 10. It is further noted that the struts 61 and 62, as well as the legs of the cover support 66 are sufficiently spaced so as to allow passage of a relatively long mat or carpet which is substantially as wide as the table 2 to pass from behind the table 2 and beneath the cover 10 when the cover 10 is in the open orientation thereof. This spacing can be seen in FIG. 3. This spacing allows carpets or mats of virtually any length to be passed in sequential segments beneath the cover 10 so as to allow the apparatus 1 to set dye positioned on any such segments.

Figure 7:
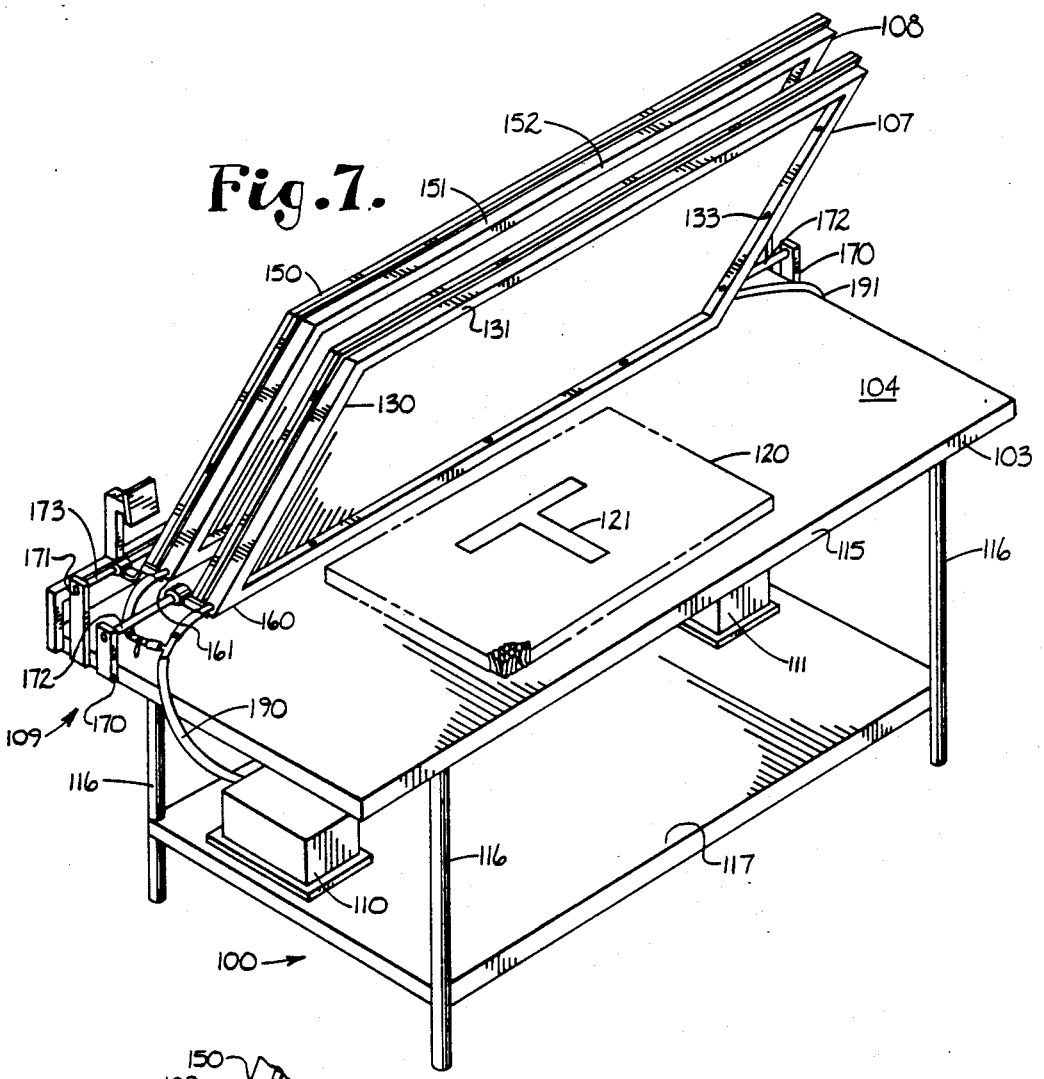
FIG. 7 is a perspective view of a modified dye setting apparatus in accordance with the present invention having two covers to receive and set dye on multiple mats simultaneously, with both covers in an open position.
Figure 8:
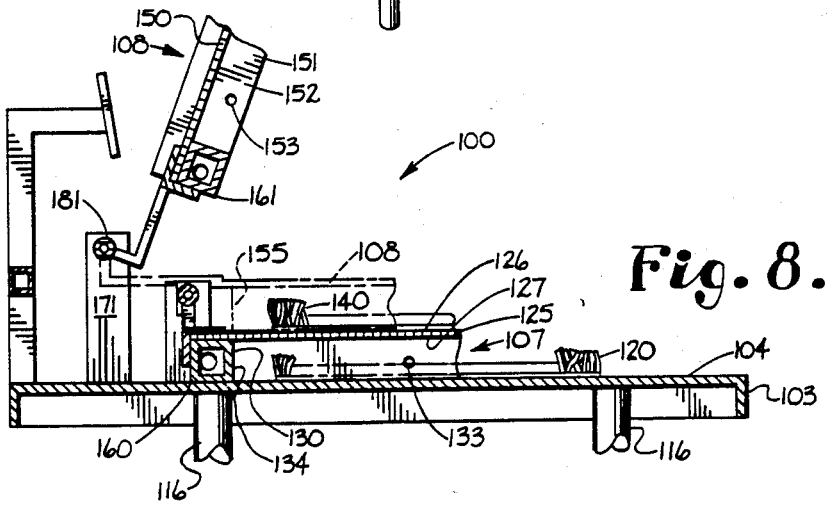
FIG. 8 is an enlarged and fragmentary side elevational view of the modified dye setting apparatus showing a lower cover in covering relationship to a mat and an upper cover in an open position and further showing the upper cover in phantom in a mat covering position, with portions broken away to show detail thereof.

Illustrated in FIGS. 7 and 8 is a modified embodiment of a dye setting apparatus in accordance with the present invention and generally designated by the reference numeral 100. The dye setting apparatus 100 is, in many respects, similar to the apparatus 1 of the previous embodiment and, consequently, many of the features that are the same between the apparatus 1 and the apparatus 100 are not discussed in great detail with respect to the apparatus 100.

The apparatus 100 includes a table 103 providing a support surface 104; a pair of first and second covers 107 and 108 pivotally connected to the table 103 by securing and hinge means such as the illustrated securing and hinge mechanism 109; and a pair of steam generators 110 and 111.

The table 103 includes an upper shelf 115 supported by a plurality of legs 116 and a lower shelf 117. The steam generators 110 and 111 are shown supported by the lower shelf 117.

The first cover 107 is a lower cover having a closed position which is illustrated in FIG. 8. The first cover 107 also has an open position illustrated in FIG. 7. When in the closed position, the first cover 107 effectively covers a mat 120 placed on and supported by the surface 104. The mat 120 includes thereon dye 121 in the form of a logo to be set by the apparatus 100.

The first cover 107 comprises an upper wall or panel 125 having a generally planar upper surface 126 and a generally planar lower surface 127 and the surfaces 126 and 127 are generally horizontally aligned when the cover 107 is in the covering or dye setting position thereof. The cover 107 also includes a rectangular support structure 130 constructed of elongate rectangular tubing 131 showing so as to extend generally around the periphery of the upper panel 125.

The tubing 131 includes a plurality of apertures 133 generally equally spaced therealong so as to face inwardly toward a chamber 134 formed by the surface 104, the upper panel 125 and the support structure tubing 131 so as to surround the mat 120 when in the dye setting position thereof.

When in the dye setting position, the upper panel 125 is generally horizontally aligned and is preferably constructed of an insulative material to prevent substantial transfer of heat between surfaces 126 and 127. Also, preferably, the upper panel 125 is constructed of a material, such as plywood, which partially absorbs moisture condensation and generally discourages the formation of drips of condensation. The upper panel upper surface 126 supports a second mat 140, when in the dye setting position thereof.

The second cover 108 is similar to the first cover 107 having an upper wall or panel 150, a support structure 151 including tubing 152 arranged around the lower periphery of the upper panel 150 and having a plurality of inwardly opening apertures 153 therein. The panel 150 preferably has a planar undersurface, is generally insulative and constructed of a material to discourage formation of water droplets from steam condensation thereon. When in the closed position thereof, the second cover 108 is positioned on top of or in a stacked relationship with respect to the first cover 107 and effectively forms an upper cover in covering and surrounding relationship to the mat 140 which is then enclosed in a chamber 155 formed between the first cover upper surface 126, the second cover upper panel 150 and the second cover support structure tubing 151.

When in the raised position thereof, covers 107 and 108 have ends 160 and 161 respectively which are spaced above the surface 104 and the first cover upper surface 126 respectively such that mats of a size larger than can fit within the chambers 134 and 155 can be slid rearwardly to allow the covers 107 and 108 to be lowered to set dye at a different location thereon. Preferably, there is sufficient give within the securing and hinge mechanism 109 to allow the covers 107 and 108 to fit flat against the supporting surfaces 104 and 126 respectively thereof, when the mats being treated are sufficiently small to fit within the chambers 134 and 155, yet will allow the covers 107 and 108 to still be placed in the dye setting position thereof and be spaced slightly from the surfaces 104 and 126 respectively, if the mats must extend beneath the cover support structures 130 and 151.

The support hinge mechanism 109 includes a first pair of struts 170 attached to the table 103 an a second pair of struts 171 also attached to the table 103 in slightly spaced relationship behind struts 170. Coaxially extending from each of the struts 170 are a pair of elongate rods 172 and connecting the struts 171 is an elongate rod 173. The rod 173 extends between opposite sides of the table 103 and the rods 172 extend inwardly from opposite sides of the table 103. Pivotally mounted on the rods 172 are a plurality of hinge elements 180 which are attached to the first cover 107 near the end 160 thereof. Likewise, a plurality of hinge elements 181 are pivotally mounted on the rod 173 and attached to the second cover 108 near the end 161 thereof.

The support and hinge mechanism 109 allows the covers 107 and 108 to be pivoted between the dye setting position thereof, such as is shown for cover 107 in FIG. 8 and in phantom for cover 108 in FIG. 8, and the open position thereof which is illustrated for both covers 107 and 108 in FIG. 7.

Steam conduits 190 and 191 connect the steam generators 109 and 110 respectively with the interior of the cover support tubing 131 and 152.

In use, a first mat 120 is placed on the surface 104 and the cover 107 is lowered to a dye setting position thereof. A second cover 140 is then placed on first cover upper surface 126 and thereafter the second cover 108 is lowered to a dye setting position thereover. Steam is then conveyed to chambers 134 and 155 formed beneath the covers 107 and 108 respectively by the steam generators 110 and 111. If the mats include a dye surface which is larger than can be covered by the covers 107 and 108, the covers 107 and 108 are raised to an open position thereof and the mats 120 and thereafter 140 are moved rearwardly with respect to the covers 107 and 108 which are thereafter closed to the dye setting position thereof so as to set dye on a different location upon the mats 120 and 140.

It is foreseen that while only two covers 107 and 108 are shown in the present embodiment that additional covers could be added in accordance with the present invention to set dye on any number of mats simultaneously.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for simultaneously setting dye on multiple pieces of a dye receiving fabric by use of steam heat comprising:

(a) an upper and a lower cover; each of said covers being adapted to be placed in covering and surrounding relationship to the dye on a respective piece of the fabric so as to form a chamber with the dye of a respective piece of fabric therein; said upper and lower covers being in a stacked configuration relative to one another when setting dye such that a top surface of the lower cover provides a supporting surface for a piece of fabric wherein dye is being set within the chamber associated with said upper cover;

(b) steam generation means;

(c) means for conveying steam produced by said steam generation means to the chambers associated with said upper and lower cover when said both of said covers are in a dye setting orientation thereof.

2. The apparatus according to claim 1 wherein:

(a) each of said covers having an interior surface constructed of material substantially resistant to transfer of heat.

3. The apparatus according to claim 1 including:

(a) securing means and hinge means; said securing means for securing said lower cover and said upper cover to a planar surface used to provide support for a respective piece of the fabric to be dyed in the chamber associated with said lower cover.

4. The apparatus according to claim 1 wherein:

(a) said hinge means connects each of said covers at one end thereof to said securing means and allows each of said covers to rotate between a covering position and an open position thereof;

(b) said hinge means including spacing structure such that, when each of said covers is in the open position thereof, said hinge means spaces the lower cover end, whereat the lower cover end is connected to said hinge means, above the planar surface so as to allow a piece of fabric to pass unobstructed between the surface and said lower cover end and said hinge means spaces the upper cover end, whereat the upper cover end is connected to said hinge means, above said lower cover so as to allow a piece of fabric to pass unobstructed between said lower cover and said upper cover end, thereby allowing said apparatus to set dye on materials larger than said apparatus.

5. An apparatus for setting dye in multiple pieces of a dye receiving fabric by use of steam heat comprising:

(a) a plurality of covers positioned in stacked relationship to one another when setting dye; each of said covers adapted to be placed in covering and surrounding relationship to the dye on a respective piece of the fabric so as to form a chamber with dye of a respective piece of fabric therein;

(b) steam generation means;

(c) means for conveying steam produced by said steam generation means to each of the chambers associated with said covers when said covers are in a dye setting orientation thereof;

(d) each of said covers having an interior surface constructed of material substantially resistant to transfer of heat; and (e) each of said cover interior surfaces being generally planar and horizontally aligned when a respective cover is in the dye setting orientation thereof and constructed of material adapted to absorb a substantial quantity of water condensed thereon.

6. The apparatus according to claim 5 wherein:

(a) the inner surface of said cover is constructed of plywood.

7. The apparatus according to claim 5 wherein:

(a) each cover that has another cover positioned thereabove also has an upper surface adapted to support a respective piece of fabric received within a cover directly thereabove when in a dye setting orientation thereof.

8. The apparatus according to claim 5 wherein:

(a) each of said covers includes support structure adapted to support said respective cover in closely spaced relationship to a respective piece of fabric when in said covering position thereof;

(b) each of said support structures comprising tubing having an interior channel;

(c) each of said support structures having a plurality of apertures positioned so as to allow flow between a respective channel and respective chamber when a respective cover is in the dye setting orientation thereof; and (d) said steam generation means being flow connected with each of said channels so as to allow the selective dispersion of steam through the respective apertures thereof into a respective chamber when a respective cover is in the dye setting orientation thereof.

9. An apparatus for setting dye in a plurality of pieces of dye receiving fabric comprising:

(a) a generally planar support surface adapted to support a first piece of the fabric;

(b) a plurality of covers positioned on top of one another when in a dye setting orientation thereof; each of said covers being adapted to be placed in a covering position over one of said pieces of fabric so as to be in covering and surrounding relationship to dye on the respective piece of fabric and so as to form a respective chamber with the dye to be set therein;

(c) each of said covers that have a cover positioned thereabove, when each cover is in the covering position thereof, includes an upper surface adapted to receive and support a piece of fabric received in respective chamber associated with the cover positioned thereabove;

(d) hinge means and support structure; said hinge means connecting one end of each of said covers to said surface and allowing each of said covers to rotate between the covering position and an open position thereof;

(e) steam generation means; and (f) flow connection means for connecting said steam generation means to each of said chambers when the covers associated therewith are in the covering position thereof.

10. A method for simultaneously setting dye on multiple pieces of a dye receiving fabric comprising the steps of:

(a) placing a first piece of said fabric on a planar surface;

(b) placing a first cover in closely spaced relationship over said first piece of fabric so as to form a first chamber with dye on said first piece of fabric therein; said first cover having a substantially planar and insulative upper interior surface;

(c) placing a second piece of fabric on an upper surface of said first cover;

(d) placing a second cover over said second piece of fabric so as to form a second chamber with dye on said second piece of fabric therein;

(e) generating steam means; and (f) simultaneously directing said generated steam to said first and second chambers while said first and second pieces of fabric are within said first and second chambers respectively and said first and second covers are in covering relationship to said first and second pieces of fabric thereby setting dye on said first and second pieces of fabric generally simultaneously.

* * * * *